US006895791B2

(12) United States Patent
Alexander et al.

(10) Patent No.: US 6,895,791 B2
(45) Date of Patent: May 24, 2005

(54) ELECTRONIC LOCK SYSTEM

(75) Inventors: Arnon Alexander, Marietta, GA (US); Andrew Weiman, Langhorne, PA (US); Jonathan P. Payne, Lawrenceville, GA (US); Pascal Georges Metivier, Atlanta, GA (US)

(73) Assignee: Onity, Inc., Norcross, GA (US)

( * ) Notice: Subject to any disclaimer, the term of this patent is extended or adjusted under 35 U.S.C. 154(b) by 11 days.

(21) Appl. No.: 10/434,878

(22) Filed: May 9, 2003

(65) Prior Publication Data

US 2004/0003633 A1 Jan. 8, 2004

Related U.S. Application Data

(60) Provisional application No. 60/379,074, filed on May 9, 2002.

(51) Int. Cl.[7] ..... E05B 47/06

(52) U.S. Cl. ..... 70/277; 70/189; 70/278.7; 70/283; 70/432; 70/477; 70/DIG. 59; 192/223.1

(58) Field of Search ..... 70/432, DIG. 59, 70/188, 189, 277, 283, 472, 149, 278.7, 467, 471, 473, 474, 477, 481, 482, 483, 222; 292/169.16, 169.22; 192/223.1

(56) References Cited

U.S. PATENT DOCUMENTS

| | | | | |
|---|---|---|---|---|
| 3,894,417 A | | 7/1975 | Taniyama | 70/156 |
| 4,127,018 A | | 11/1978 | Brand | 70/282 |
| 4,754,625 A | | 7/1988 | McGourty et al. | 70/214 |
| 5,010,752 A | | 4/1991 | Lin | 70/277 |
| 5,040,391 A | | 8/1991 | Lin | 70/277 |
| 5,083,122 A | | 1/1992 | Clark | 361/172 X |
| 5,473,236 A | | 12/1995 | Frolov | 318/236 |
| 5,544,507 A | | 8/1996 | Lin | 70/107 |
| 5,591,950 A | | 1/1997 | Imedio-Ocaña | 235/382.5 |
| 5,694,798 A | | 12/1997 | Nunez et al. | 70/283 |
| 5,953,942 A | * | 9/1999 | Doucet et al. | 70/283 |
| 5,987,945 A | | 11/1999 | Aramburu | 70/277 |
| 6,145,353 A | | 11/2000 | Doucet | 70/277 |
| 6,259,352 B1 | | 7/2001 | Yulkowski et al. | 340/5.7 |
| 6,286,347 B1 | * | 9/2001 | Frolov | 70/472 |
| 6,427,505 B2 | * | 8/2002 | Imedio Ocana | 70/422 |

* cited by examiner

*Primary Examiner*—Lloyd A. Gall
(74) *Attorney, Agent, or Firm*—Akin Gump Strauss Hauer & Feld, LLP

(57) ABSTRACT

A clutch assembly for coupling a first spindle to a second spindle. The clutch assembly has a first disc connectable to the first spindle. A first finger is operatively coupled to the first disc and pivotable between a first engaged position and a first disengaged position. The first finger opposes rotation of the first disc in a first direction when the first finger is in the first engaged position. A second disc is connectable to the second spindle. The second disc pivots the first finger from the first engaged position to the first disengaged position when the second disc is rotated in the first direction through a first range of angular positions and rotates the first disk in the first direction when the second disc is rotated beyond the first range of angular positions.

8 Claims, 10 Drawing Sheets

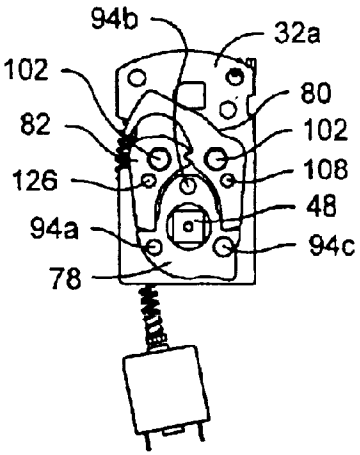
NEUTRAL POSITION
WITHOUT SECOND DISC
*Fig. 6a*
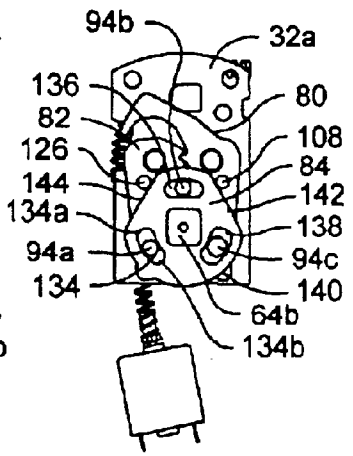
NEUTRAL POSITION
WITH SECOND DISC
*Fig. 6b*
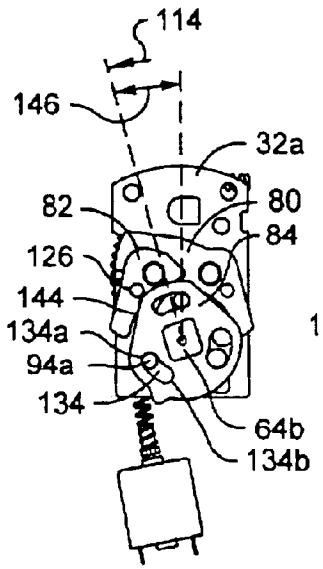
*Fig. 6c*
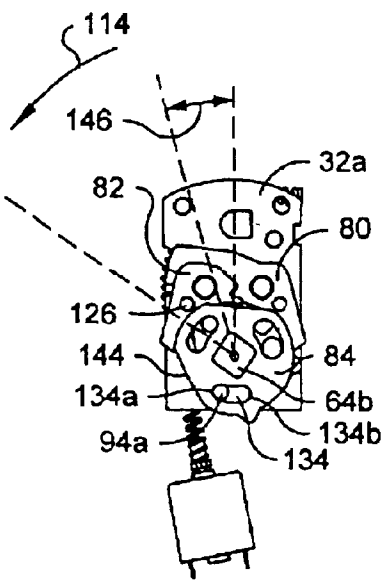
*Fig. 6d*
*Fig. 6e*
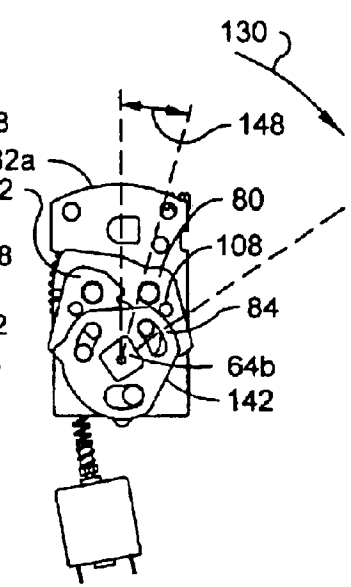
*Fig. 6f*

ELECTRONIC LOCK SYSTEM

CROSS-REFERENCE TO RELATED APPLICATIONS

This application is related to U.S. Provisional Patent Application No. 60/379,074, filed May 9, 2002, and claims the earlier filing date of the provisional application. Each of the above-identified related applications is incorporated herein by reference.

BACKGROUND OF THE INVENTION

The present invention relates generally to an electronic lock system. More particularly, the present invention relates to a door lock system in which an electronic lock assembly mountable on an inside-facing side of a door is connected to a mortise lock in the door and is actuatable by a user interface mounted on an outside-facing side of the door and in communication with an electronic controller mountable on the inside-facing side of the door.

A typical mortise lock has a generally rectangular housing that is positioned in a mortised recess in an edge of a door that is opposite a hinged edge of the door rotatably attaching the door to a doorframe. The mortise lock has a latch that retractably projects beyond the edge of the door and into an opening in an adjacent strike plate in the doorframe. The latch typically is retractable by an outside handle attached to an outside shaft connected to the latch by a locking mechanism attached to the outside-facing side of the door. The locking mechanism is actuatable by a controller also mounted on the outside-facing surface of the door. The latch also is operable by an inside handle attached to an inside shaft connected to the latch.

The location of the locking mechanism and the controller on the outside-facing surface of the door creates an undesirable security risk by being accessible for tampering. Accordingly, an electronic lock system having an electronic lock assembly and electronic controller mountable on the inside-facing side of a door removes from the unauthorized would-be entrant the opportunity for tampering with the system.

BRIEF SUMMARY OF THE INVENTION

Briefly stated, one aspect of the present invention is directed to a clutch assembly for coupling a first spindle to a second spindle. The clutch assembly comprises a first disc, a first finger and a second disc. The first disc is connectable to the first spindle and is rotatable about a first axis. The first disc has a first couple. The first finger is operatively coupled to the first disc and pivotable about a second axis between a first engaged position and a first disengaged position. The second axis is spaced from and parallel to the first axis. The first finger is configured to oppose rotation of the first disc in a first direction when the first finger is in the first engaged position. The second disc is connectable to the second spindle. The second disc has a first slot engaged by the first couple. The second disc is configured to pivot the first finger from the first engaged position to the first disengaged position when the second disc is rotated in the first direction through a first range of angular positions and to rotate the first disk in the first direction when the second disc is rotated beyond the first range of angular positions.

Another aspect of the present invention is directed to an electronic lock system for a door having an outside handle, an outside-facing surface, an inside handle, an inside-facing surface and a latch assembly. The electronic lock system comprises an electronic lock assembly and an electronic control assembly. The electronic lock assembly comprises a lock assembly housing, a first spindle assembly, a second spindle assembly, clutch assembly, a drive assembly, and a sensor assembly. The lock assembly housing is connectable to the inside-facing surface of the door. The assembly housing assembly comprises a base having a sidewall, a first plate spaced from and supported by the base, a second plate spaced from and supported by the first plate, and a cover spaced from the second plate and removably supported by the sidewall. The first spindle assembly is between the base and the first plate, the first spindle assembly connectable to the outside handle and to the latch assembly. The second spindle assembly is between the second plate and the cover. The second spindle assembly is connectable to the inside handle. The clutch assembly is between the first plate and the second plate. The clutch assembly connects the first spindle assembly to the second spindle assembly. The drive assembly is connected to the clutch assembly. The sensor assembly is adjacent the clutch assembly and has an output when actuated by the clutch assembly. The electronic control assembly comprises user interface and a controller in electrical communication with the user interface, the drive assembly, and the sensor assembly. The controller is configured to determine a condition of the clutch assembly based on the output of the sensor assembly.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings:

FIG. 6*a* is substantially the same as FIG. 5*b* and is included with FIGS. 6*b*–6*f* for ease of reference;

FIGS. 6*b* through 6*f* are plan views of a portion of the clutch assembly of the present invention showing the second disc in a first position and rotated through a first and second range of angular positions;

DETAILED DESCRIPTION OF THE INVENTION

Figure 1A:
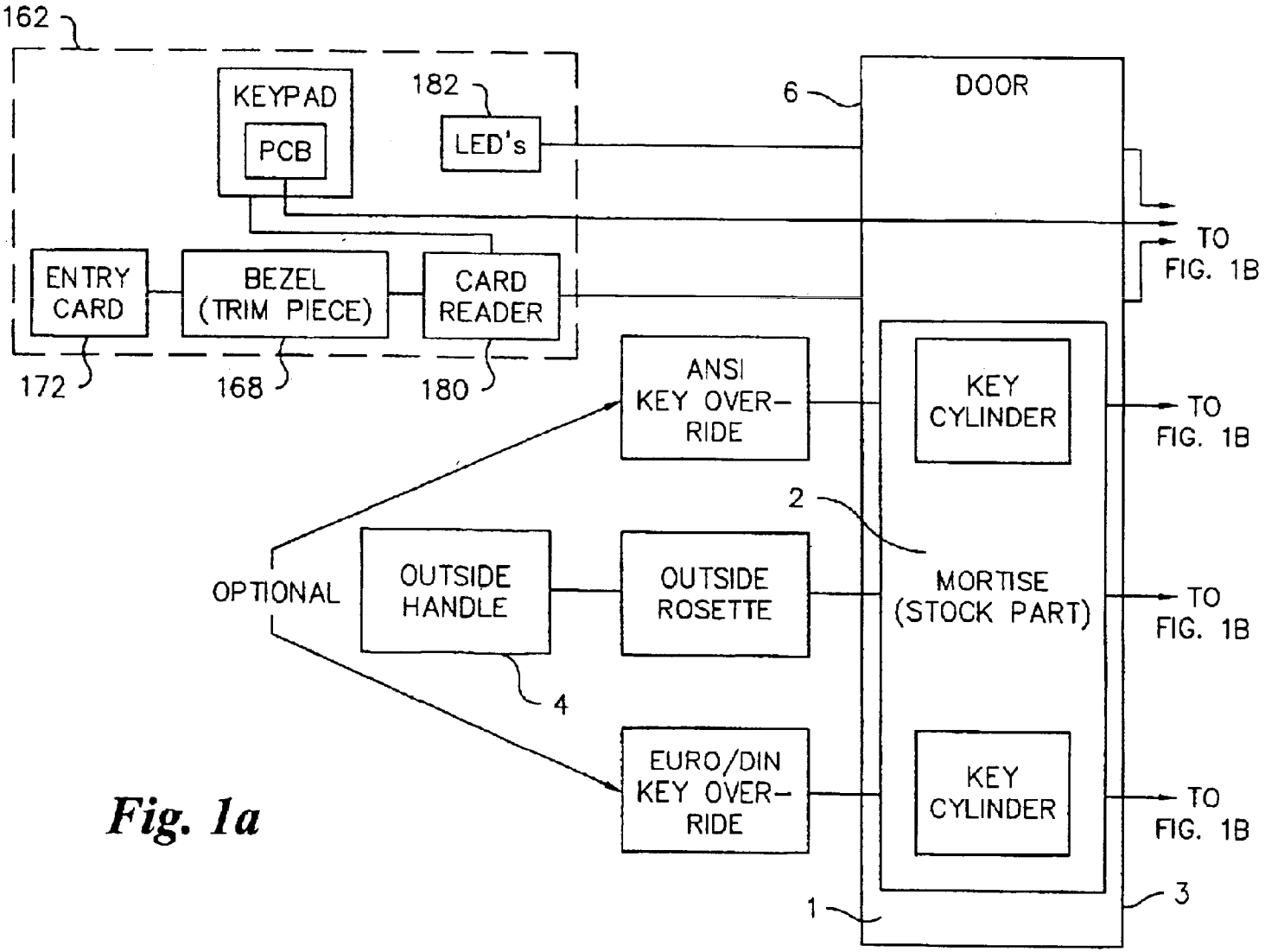
FIGS. 1*a* and 1*b* are portions of a schematic block diagram of a first preferred embodiment of the electronic lock system in accordance with the present invention.
Figure 1B:
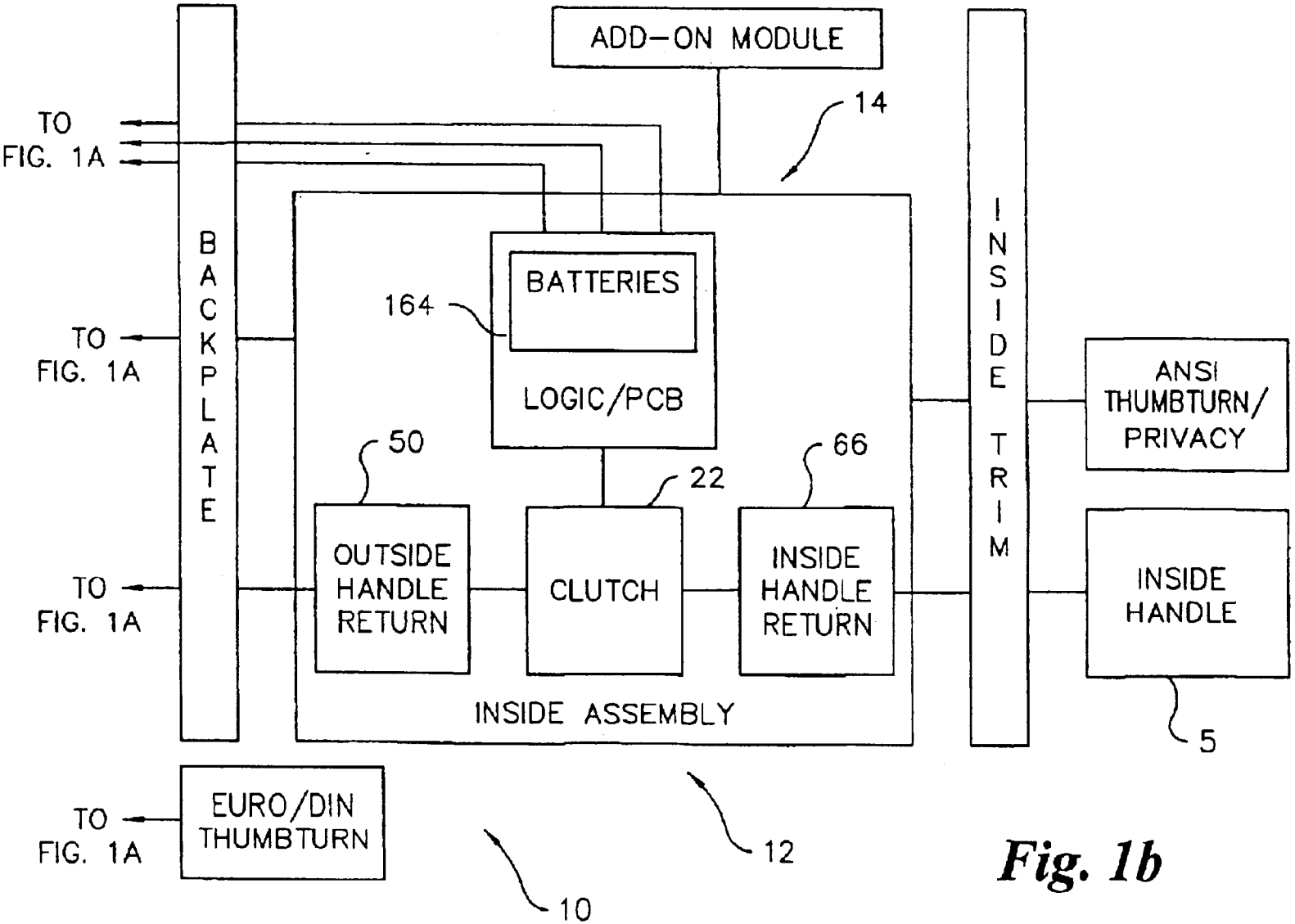

Referring to the drawings in detail, where like numerals indicate like elements throughout there is shown in FIGS. 1–11 a first preferred embodiment of the electronic lock system, generally designated 10, and hereinafter referred to as the "Lock System" 10, in accordance with the present invention. Referring to FIG. 1, the Lock System 10 is for releasably securing a door 1 having a latch assembly 2 to a doorframe (not shown). The door 1 and latch assembly 2 can be any well known door and latch assembly, such as a door having a hinged edge pivotably attached to a doorframe and an opposite edge having a mortised recess in which a typical mortise lock assembly having a latch (not shown) that retractably projects beyond the edge of the door 1 and into an opening in an adjacent strike plate (not shown) in the doorframe. The Lock System 10 has an electronic lock assembly 12 and an electronic control assembly 14 (FIG. 1).

Referring to FIGS. 1–6, the electronic lock assembly has a lock assembly housing 16 that has therein a first spindle assembly 18, a second spindle assembly 20, a clutch assembly 22, a drive assembly 24 and a sensor assembly 26.

Figure 2:
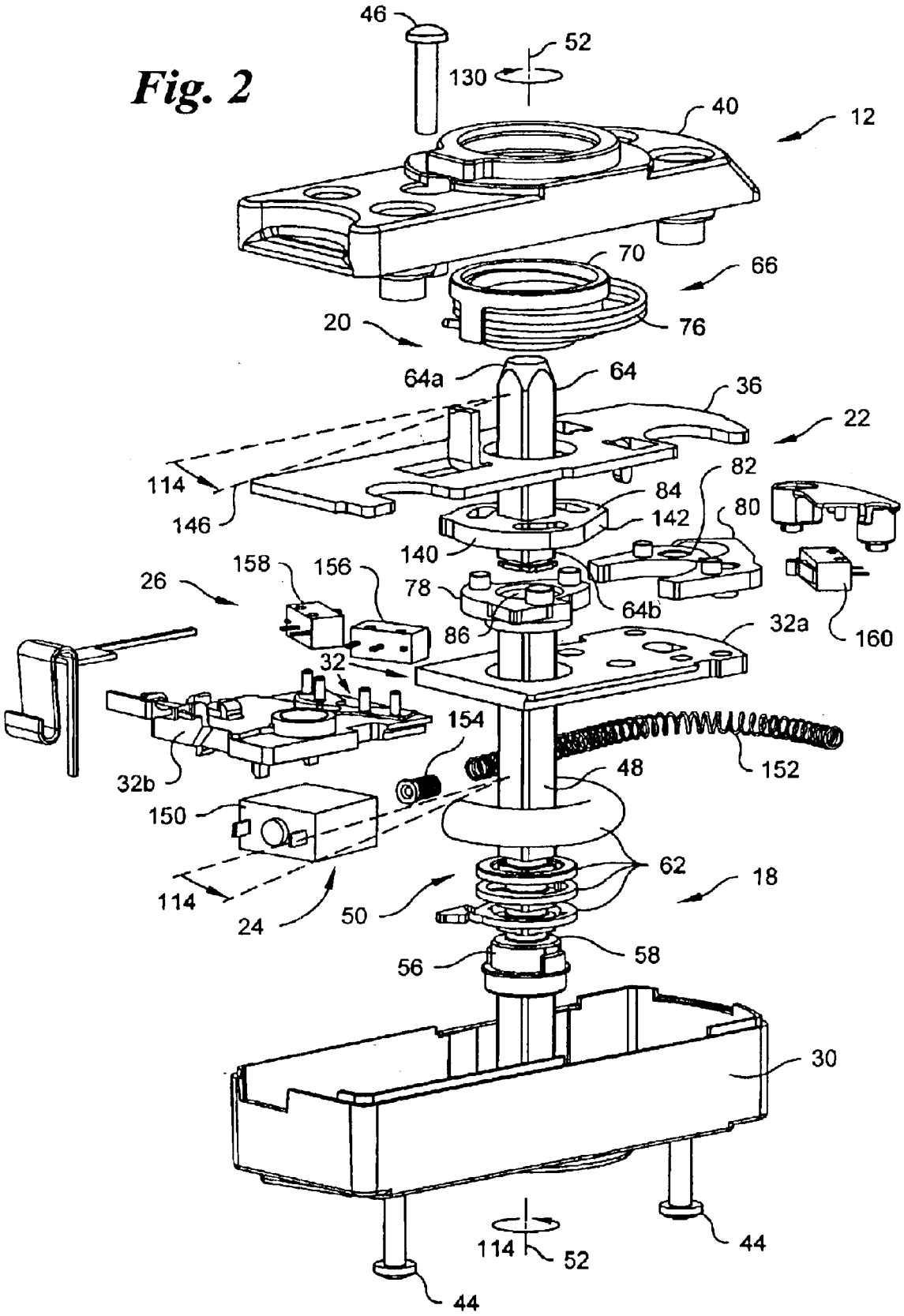
FIG. 2 is a enlarged exploded perspective view of the electronic lock assembly in accordance with the present invention.
Figure 3:
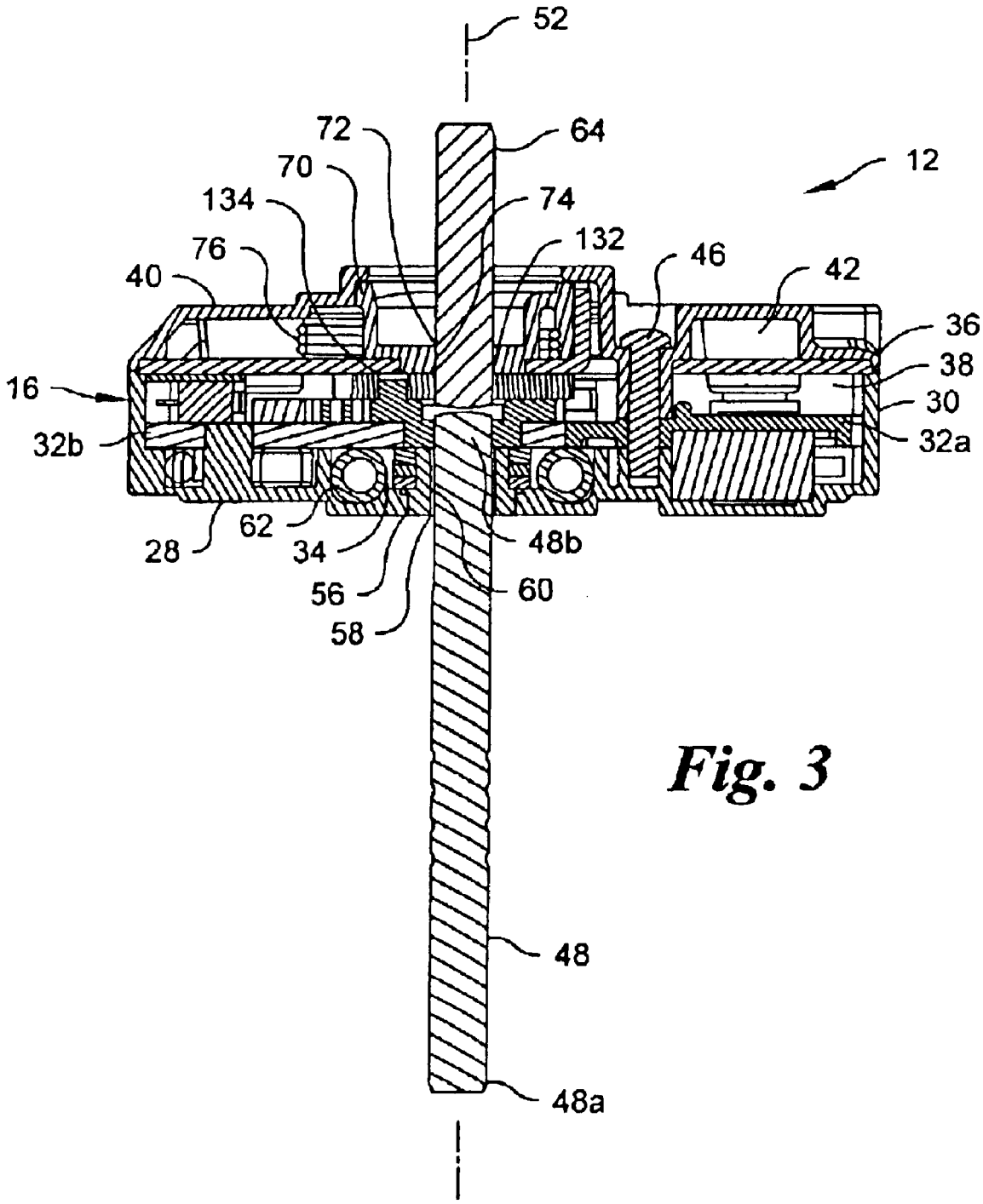
FIG. 3 is a side center line cross sectional view of the electronic lock assembly in accordance with the present invention.

Referring to FIGS. 1–3, the lock assembly housing 16 has a base 28 having an upwardly extending sidewall 30. A first plate 32 within the lock assembly housing 16 is spaced from and supported by the base 28. The first spindle assembly 18 is between the base 28 and the first plate 32 and is connectable to the outside handle 4 and the latch assembly 2 as further described below. In a preferred embodiment, the base 28, a lower portion of the sidewall 30 and the first plate 32 form a first chamber 34 that contains the first spindle assembly 18 and the drive assembly 24. The first plate 32 preferably comprises a first segment 32*a* and a second segment 32*b*, adjacent the first segment 32*a*. The first segment 32*a* preferably is formed from a metal such as steel and the second segment 32*b* preferably is formed from a moldable polymeric material. However, the first and second segments 32*a*, 32*b* may be made from the same material.

A second plate 36 within the lock assembly housing 16 is spaced from and supported by the first plate 32. The clutch assembly 22 is between the first plate 32 and the second plate 36 and connects the first spindle assembly 18 to the second spindle assembly 20 as discussed below. In a preferred embodiment, the first plate 32, a middle portion of the sidewall 30 and the second plate 36 form a second chamber 38 that contains the clutch assembly 22 and the sensor assembly 26.

A cover 40 is spaced from the second plate 36 and is removably supported by the sidewall 30. The second spindle assembly 20 is between the second plate 36 and the cover 40 and is connectable to the inside handle 5 as further described below. In a preferred embodiment, the cover 40, an upper portion of the sidewall 30 and the second plate 36 form a third chamber 42 that contains the second spindle assembly 20. The lock assembly housing 16 is connectable to an inside-facing, secured or restricted surface 3 of the door 1. Preferably, but not necessarily, the lock assembly housing 16 is removably attached to the inside-facing surface 3 of the door 1 by a plurality of any well known fastener 44, such as screws, bolts, or the like that pass through holes in the base 28. Preferably, but not necessarily, the cover 40 is removably attached to the sidewall 30 by a cover fastener 46 that passes through the first and second plates 32, 36 and is threadedly secured to the base 28. However, the cover 40 may also be fastened by other well-known methods such as compression or friction fit stud or pin.

The first spindle assembly 18 has a first spindle 48 and a first spindle return 50. The first spindle 48 extends through the first plate 32, the base 28 and the door 1 and is connectable to the latch assembly 2 by a variety of methods well-known to those skilled in the art. The first spindle 48 has a first end 48*a* and a second end 48*b*. The first end 48*a* is connectable to an outside handle 4 of the door 1. The first spindle 48 is rotatable about a first axis 52 and has a first angular position with respect to rotation about the first axis 52 as shown in FIG. 2. The first spindle 48 preferably has a generally square cross-section and is fabricated from a metal such as steel. However, the spindle 48 may have other cross-sectional shapes such as a polygon with an arbitrary number of sides or have a generally circular cross-section and may be fabricated from metals other than steel, such as titanium, or fiber reinforced polymeric materials.

The first spindle return 50 is connected to the first spindle 48 and is configured to bias the first spindle 48 in the first angular position. Typically, the first angular position corresponds to the position of the first spindle 48 when the outside handle 4 is in a horizontal position and the latch engages the strike plate. Preferably the first spindle return 50 has a first spindle hub 56 that is concentric with the first spindle 48 and is journaled with the base 28. The first spindle hub 56 has a first spindle hub bore 58 through which a portion of the first spindle 48 may slideably pass for ease of assembling the electronic lock assembly 12. The first spindle hub bore 58 preferably has a cross-sectional shape that corresponds to the cross-sectional shape of the first spindle 48 and a first sidewall 60 in contact with the first spindle 48 for applying thereto a torque generated by a compression spring assembly 62 concentric with the first spindle hub 56 when the first spindle 48 is angularly displaced from the first angular position. However, the first spindle return 50 can be any well known conventional mechanism for returning an angularly displaced spindle to an initial angular position.

The second spindle assembly 20 has a second spindle 64 and a second spindle return 66. The second spindle 64 extends through the second plate 36 and the cover 40. The second spindle 64 has a first end 64*a* and a second end 64*b*. The first end 64*a* is connectable to an inside handle 5 of the door 1. The second spindle 64 is rotatable about the first axis 52 and has a second angular position with respect to rotation about the first axis 52 as shown in FIG. 2. Typically, the second angular position corresponds to the position of the second spindle 64 when the inside handle 5 is in a horizontal position and the latch engages the strike plate. The second spindle 64 is preferably shorter than the first spindle 48 but may be equal to or greater than the length of the first spindle 48 and is substantially the same in cross-sectional shape and material as the first spindle 48.

The second spindle return 66 is connected to the second spindle 64 and is configured to bias the second spindle 64 in the second angular position. Preferably the second spindle return 66 has a second spindle hub 70 that is concentric with the second spindle return 66 and is journaled with the cover 40. The second spindle hub 70 has a bore 72 through which a portion of the second spindle 64 may slideably pass for ease of assembling the electronic lock assembly 12. The bore 72 preferably has a cross-sectional shape that corresponds to the cross-sectional shape of the second spindle 64 and a sidewall 74 in contact with the second spindle 64 for applying thereto a torque generated by a coil spring 76 concentric with the second spindle hub 70 when the second spindle 64 is angularly displaced from the second angular position. However, the second spindle return 66 can be any well known conventional mechanism for returning an angularly displaced spindle to an initial angular position without departing from the scope and spirit of the invention.

The clutch assembly 22 comprises a first disc 78, a first finger 80, a second finger 82 and a second disc 84. The first disc 78 is connectable to the first spindle 48 and rotatable about the first axis 52. In a preferred embodiment, the first disc 78 is connected to the second end 48*b* of the first spindle 48 for rotation therewith and is concentric with the first spindle 48. Preferably, the first disc 78 has a bore 86 into which the second end 48*b* of the first spindle 48 may be slideably inserted. However, the first disc 78 may be fixedly attached to the second end 48*b* or be in unity with the second end 48*b*.

Referring to FIGS. 4*a*, 4*b*, 5*a* and 5*b*, the first disc 78 has a first contact 88 and a second contact 90 spaced from the first contact 88. Preferably the first and second contacts 88, 90 are portions of an edge 92 defining the perimeter of the first disc 78 but may also be structural members attached to the first disk 78 and positioned for contact with the first and second fingers 80, 82. Preferably, the first and second contacts 88, 90 extend generally radially outwardly and are contoured to aid alignment of the first and second fingers 80, 82 with the first and second contacts 88, 90. Preferably, the first and second contacts 88, 90 have a generally arcuate-shape corresponding in curvature to the first and second radii, respectively, of the first and second fingers 80, 82 discussed below. The first disc 78 may have only one contact or may have more than two contacts without departing from the spirit and scope of the invention. Those of ordinary skill in the art will understand that the number of contacts depends, in part, on whether the intended use of the Lock System 10 is to releaseably secure the first spindle 48 with respect to rotation in one direction or rotation bidirectionally.

The first disc 78 additionally has a first couple 94*a* for coupling the first disc 78 to the second disc 84 as further discussed below. Preferably, but not necessarily, the first disc 78 additionally has a second couple 94*b* and a third couple 94*c*. The first, second, and third couples 94*a*, 94*b*, 94*c* extend upwardly from the first disc 78 and are generally equidistantly spaced about the first axis 52. Those having ordinary skill in the art will understand that first disc 78 may have only one couple or may have more than one couple without departing from the scope and spirit of the invention. The artisan will also understand that the first and second spindles 48, 64 may require additional support, such as having the second end 48*b* of the first spindle 48 journaled with the second end 64*b* of the second spindle 64 if only one couple couples the first disc 78 to the second disc 84.

Figure 4B:
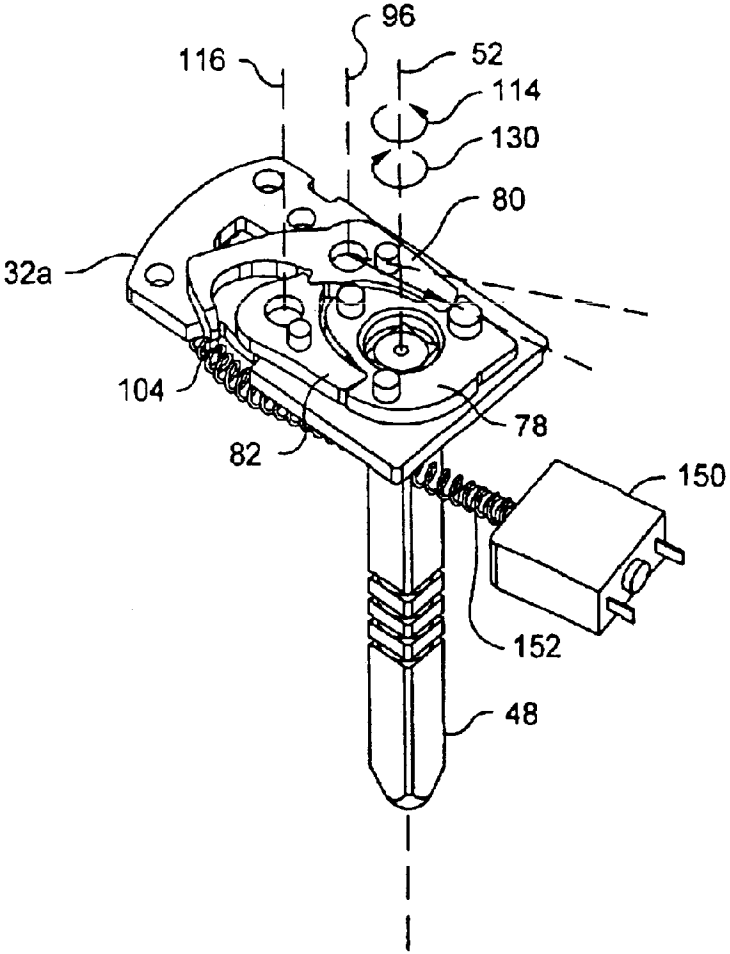
FIGS. 4*a* and 4*b* are perspective views of a portion of the clutch assembly of the electronic lock assembly in accordance with the present invention showing the first and second fingers in the engaged and disengaged positions.
Figure 4A:
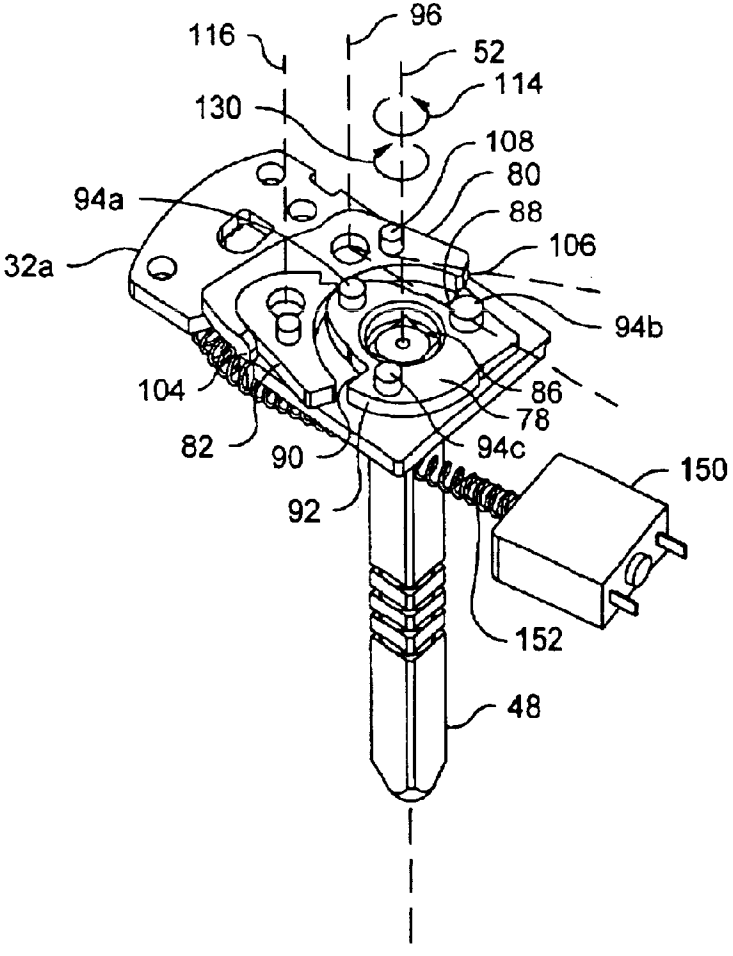
Figure 5B:
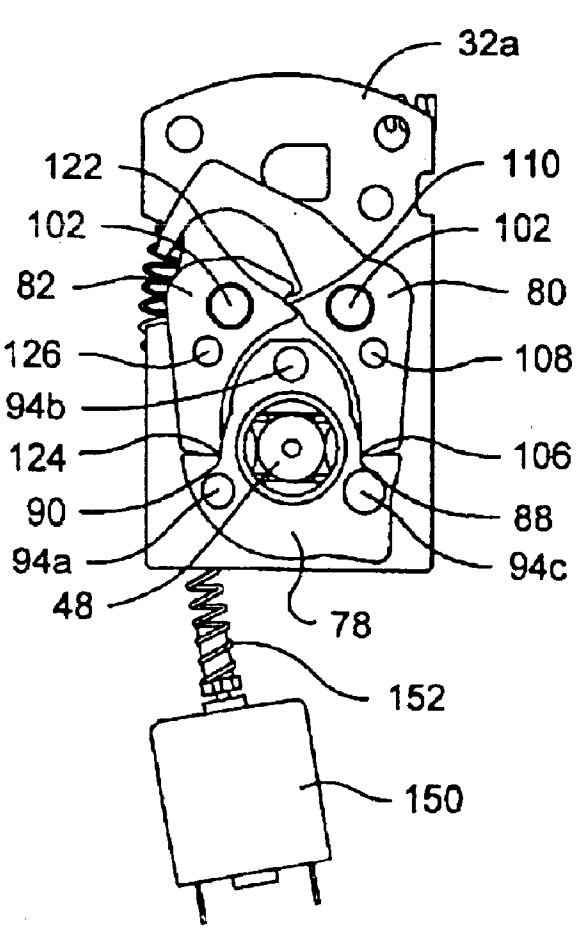
FIGS. 5*a* and 5*b* are plan views of the portion of the clutch assembly of FIGS. 4*a* and 4*b;*
Figure 5A:
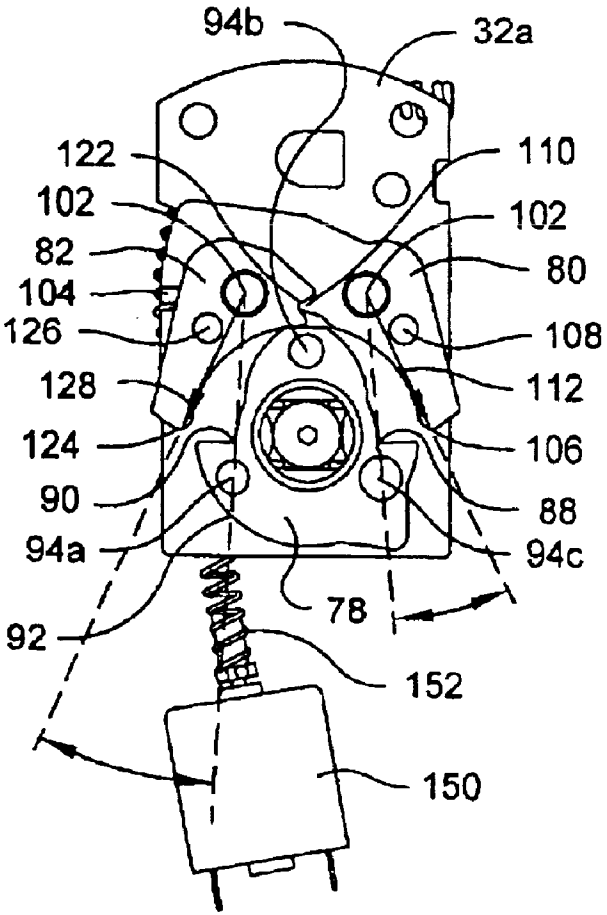
Figure 7:
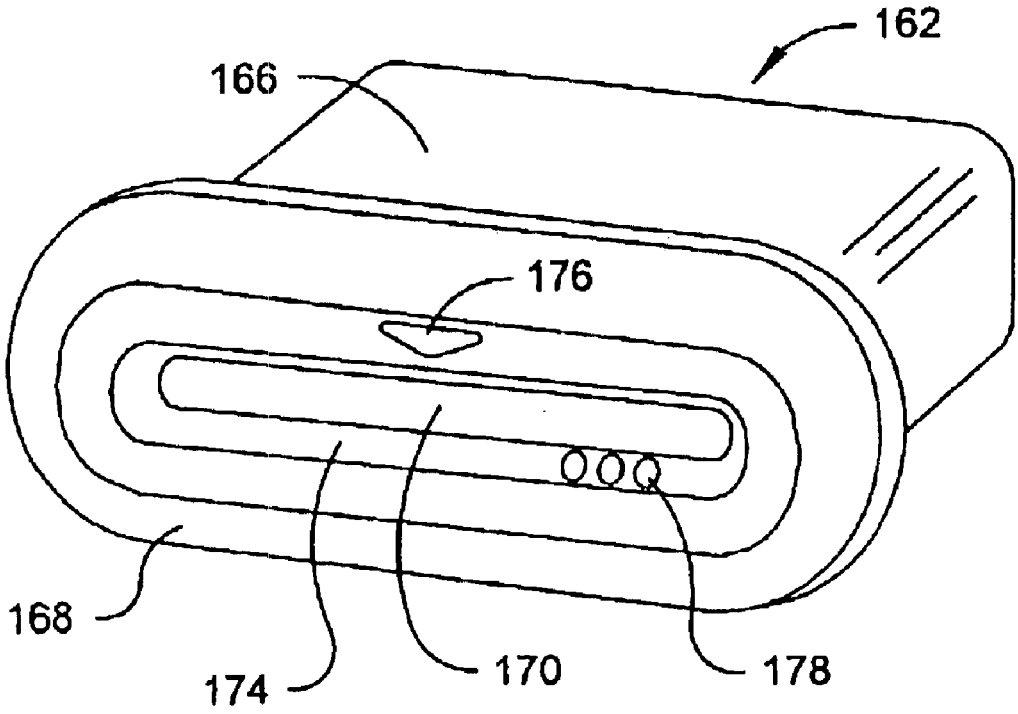
FIG. 7 is a front perspective view of a preferred embodiment of the user interface having a card reader in accordance with the present invention.
Figure 8:
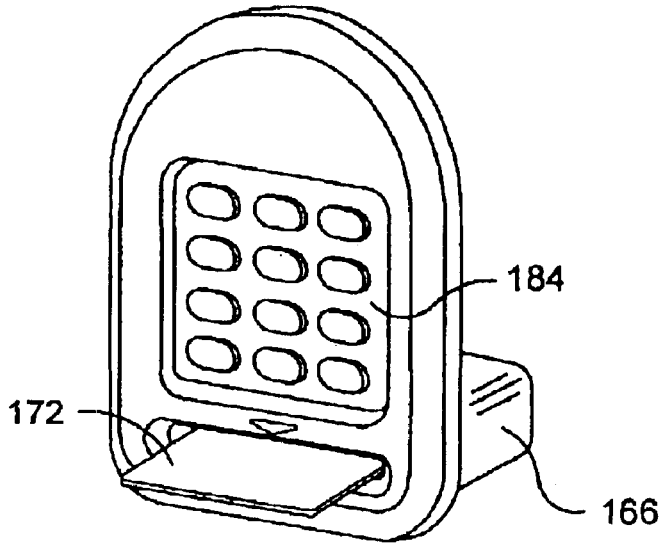
FIG. 8 is a front perspective view of a preferred embodiment of the user interface having a card reader and a key pad in accordance with the present invention.
Figure 9:
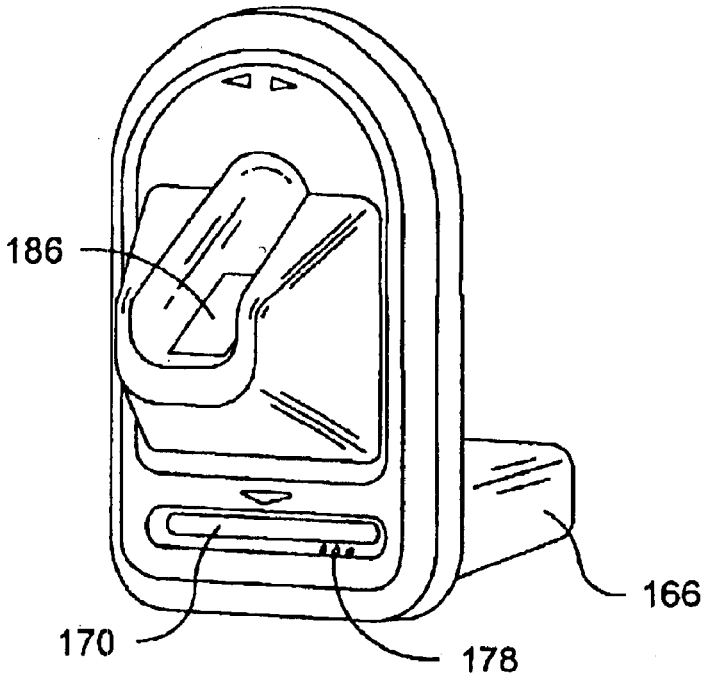
FIG. 9 is a front perspective view of a preferred embodiment of the user interface having a card reader and a finger scanner in accordance with the present invention.
Figure 10:
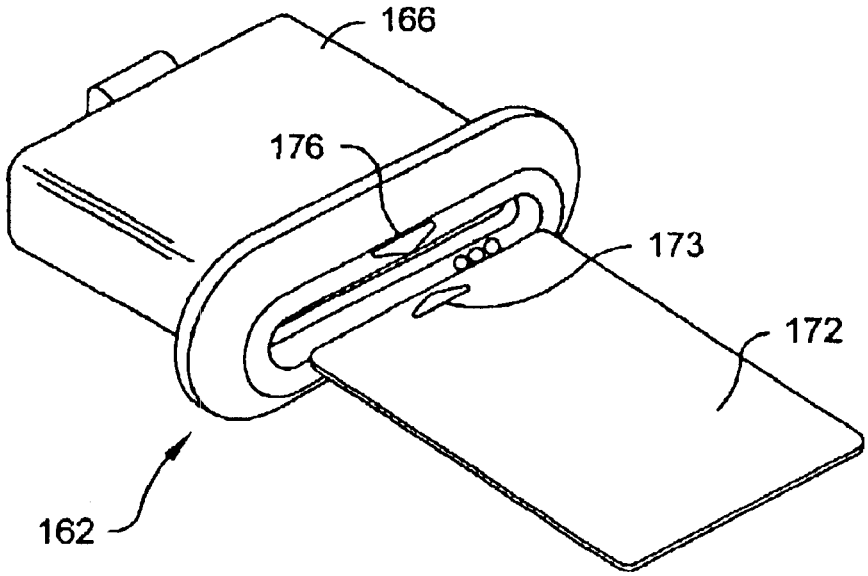
FIG. 10 is a top perspective view of the card reader of FIG. 7 with a card positioned for insertion therein.
Figure 11:
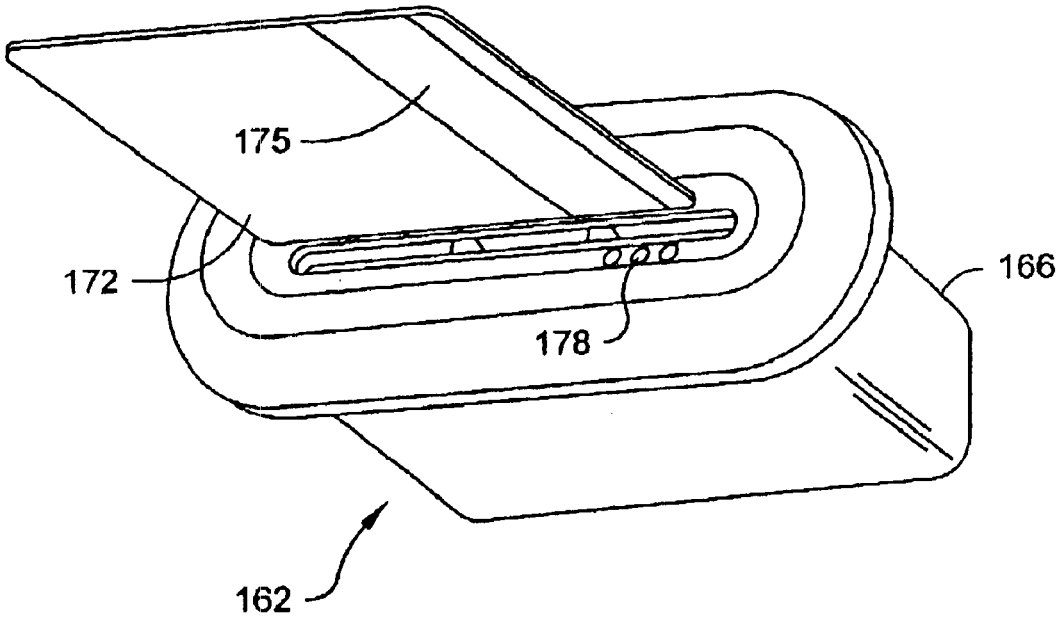
FIG. 11 is a bottom perspective view of the card reader of FIG. 7 with a card positioned for insertion therein.

The first finger 80 is operatively coupled to the first disc 78 and is pivotable about a second axis 96 between a first engaged position as shown in FIG. 4*b* and FIG. 5*b* and a first disengaged position as shown in FIG. 4*a* and FIG. 5*a*. The second axis 96 is spaced from and parallel to the first axis 52. The first finger 80 is configured to oppose rotation of the first disc 78 in a first direction 114 when the first finger 80 is in the first engaged position. Preferably, the first finger 80 is pivotably connected to the first segment 32*a* of the first plate 32 by a pivot pin 102. The first finger 80 has a first link 104, a first stop 106, a first release 108, and a first lobe 110. The first link 104 is for connecting the first finger 80 to the drive assembly 24 discussed below for pivoting the first finger 80 about the second axis 96 between the first engaged position and the first disengaged position. The first stop 106 is spaced a first radius 112 from the second axis 96 and is in registry with the first contact 88 when the first finger 80 is in the first engaged position. The first stop 106 is spaced from the first contact 88 when the first finger is in the first disengaged position. The first stop 106 is configured to apply to the first contact 88 a first reactive force opposing rotation of the first spindle 48 in a first direction 114 when the first finger 80 is in the first engaged position. The first reactive force is directed outwardly along the first radius 112. The first release 108 is for engaging the second disc 84 as discussed below.

The second finger 82 is operatively coupled to the first disc 78 and is pivotable about a third axis 116 between a second engaged position as shown in FIG. 4*b* and FIG. 5*b* and a second disengaged position as shown in FIG. 4*a* and FIG. 5*a*. The third axis 116 is spaced from and parallel to the first and second axes 52, 96. The second finger 82 is configured to oppose rotation of the first disc 78 in a second direction 130 when the second finger 82 is in the second engaged position. Preferably, the second finger 82 is pivotably connected to the first segment 32*a* of the first plate 32 by a pivot pin 102. The second finger 82 has a second link 122, a second stop 124, and a second release 126. The second link 122 is configured to engage the first lobe 110 of the first finger 80 and functions generally as a cam follower coupling the pivoting of the first finger 80 with the pivoting of the second finger 82. The second stop 124 is spaced a second radius 128 from the third axis 116 and is in registry with the second contact 90 when the second finger 82 is in the second engaged position. The second stop 124 is spaced from the second contact 90 when the second finger 82 is in the second disengaged position. The second stop 124 is configured to apply to the second contact 90 a second reactive force opposing rotation of the first spindle 48 in a second direction 130 when the second finger 82 is in the second engaged position. The second reactive force is directed outwardly along the second radius 128.

Those of ordinary skill in the art will understand from the present disclosure that the clutch assembly 22 may have only one finger without departing from the scope of the present invention. The artisan will further understand that the number of fingers depends, in part, on whether the intended use of the Lock System 10 is to releaseably secure the first spindle 48 with respect to rotation in one direction or bidirectionally. Still further, the artisan will understand that the second link 122 of the second finger 82 also may function as a cam and the first lobe 110 of the first finger 80 also may function as a cam follower if the rotation of the first spindle 48 is bidirectional in the intended use of the Lock System 10.

Referring to FIGS. 2, 3, and 6*a*–6*f*, the second disc 84 is connectable to the second spindle 64 and is rotatable about the first axis 52. The second disc 84 is configured to pivot the first finger 80 from the first engaged position to the first disengaged position when the second disc 84 is rotated in the first direction 114 through a first range 146 of angular positions and to rotate the first disk 78 in the first direction 114 when the second disc 84 is rotated beyond the first range 146 of angular positions.

In a preferred embodiment, the second disc 84 is connected to the second end 64*b* of the second spindle 64 for rotation therewith and is concentric with the second spindle 64. Preferably, but not necessarily, the second disc 84 is fixedly attached to the second end 64*b* of the second spindle 64 or is in unity with the second end 64*b*. Alternatively, the second disk 84 may have a bore 132 through which the second end 64*b* of the second spindle 64 may be slideably inserted without departing from the scope of the invention disclosed herein.

The second disc 84 has a first slot 134 engaged by the first couple 94*a*. The first slot 134 has a first end 134*a* and a second end 134*b* spaced from the first end 134*a*. Preferably, the first couple 94*a* of the first disc 78 extends into the first slot 134 about equidistantly from the first and second ends 134*a*, 134*b*, thereby coupling the second disc 84 to the first disc 78 when first and second fingers 80, 82 are in the first and second engaged positions and oppose rotation of the first disc 78 as shown in FIG. 6*b* and as further described below. Preferably, but not necessarily, the second disc 84 additionally has a second slot 136 engaged by the second couple 94*b* and a third slot 138 engaged by a third couple 94*c*. Preferably, the first, second, and third slots 134, 136, 138 are equidistantly spaced about the first axis 52. The second and third slots 136, 138 have substantially the same configuration as the first slot 134 and cooperate with the second and third couples 94*b*, 94*c* in substantially the same manner as the first slot 134 cooperates with the first couple 94*a*. Accordingly, for brevity only the cooperation between the first slot 134 and the first couple 94*a* is disclosed below.

The second disc 84 has a perimeter surface 140 with a first portion and a second portion spaced from the first portion. The first portion of the perimeter surface 140 is configured to engage the first release 108, to pivot the first finger 80 from the first engaged position to the first disengaged position when the second disc 84 is rotated in the first direction 114 through the first range 146 of angular positions, and to rotate the first disk 78 in the first direction 114 when the second disc 84 is rotated beyond the first range 146 of angular positions. The second portion of the perimeter surface 140 is configured to engage the second release 126, to pivot the second finger 82 from the second engaged position to the second disengaged position when the second disc 84 is rotated in the second direction 130 through a second range 148 of angular positions, and to rotate the first disk 78 in the second direction 130 when the second disc 84 is rotated beyond the second range 148 of angular positions. Preferably, the first portion of the perimeter surface 140 is a first flat 142 and the second portion of the perimeter surface is a second flat 144 spaced from the first flat 142. The first flat 142 and the second flat 144 are for engaging the first release 108 and the second release 126, respectively, as discussed below.

Referring to FIG. 6*c*, the rotation of the second spindle 64 in the first direction 114 from the second angular position through a first range 146 of angular positions rotates the second disc 84, and therefore the first slot 134, such that the first end 134*a* of the first slot 134 engages the first couple 94*a* of the first disc 78. The rotation of the second spindle 64 through the first range 146 of angular positions also causes the second flat 144 to engage the second release 126 and pivot the second finger 82 from the second engaged position to the second disengaged position. The pivoting of the second finger 82, in turn, causes the first finger 80 to pivot from the first engaged position to the first disengaged position. Rotation of the second spindle 64 in the first direction 114 beyond the first range 146 of angular positions rotates the first spindle 48 as shown in FIG. 6*d*.

Referring to FIG. 6*e*, the rotation of the second spindle 64 in the second direction 130 from the second angular position through a second range 148 of angular positions rotates the second disc 84, and therefore the first slot 134, such that the second end 134*b* of the first slot 134 engages the first couple 94*a* of the first disc 78. The rotation of the second spindle 64 through the second range 148 of angular positions also causes the first flat 142 to engage the first release 108 and pivot the first finger 80 from the first engaged position to the first disengaged position. The pivoting of the first finger 80, in turn, causes the second finger 82 to pivot from the second engaged position to the second disengaged position. Rotation of the second spindle 64 in the second direction 130 beyond the second range 148 of angular positions rotates the first spindle 48 as shown in FIG. 6*f*.

Referring to FIGS. 2 and 4*a*, 4*b*, the drive assembly 24 is connected to the clutch assembly 22 and comprises a drive motor 150 and a flexible link 152. The drive motor 150 is in electrical communication with the electronic control assembly 14 and has a drive shaft (not shown) that is connected by a motor couple 154 to the flexible link 152 for rotation therewith. The flexible link 152 is connected to the first link 104 of the first finger 80 for pivoting the first finger 80 between the first engaged position and the first disengaged position. Preferably, but not necessarily, the flexible link 152 is an elongated coil spring that functions as a flexible screw or worm gear meshed with the first link 104. As the flexible link 152 is driven in rotation by the drive motor 150, the first link 104 slides along the flexible link 152, thereby pivoting the first finger 80. Alternatively configured, the flexible link 152 may comprise a spring having a first end connected to the first link 104 of the first finger 80 and a second end connected to a nut (not shown), in turn, threadedly connected to a worm gear (not shown) driven by the drive motor 150. Preferably, the worm gear is a polymeric material and is pressed onto the drive shaft (not shown) of the drive motor 150. In the alternatively configured flexible link 152, as the drive motor 150 rotates the worm gear, the nut constrained by guide (not shown) moves along the rotational axis of the worm gear, thereby displacing the spring and pivoting the first finger 80.

The sensor assembly 26 is adjacent the clutch assembly 22 and has an output when activated by the clutch assembly 22. The sensor assembly 26 comprises a first disc sensor 156, a second disc sensor 158 and a first finger sensor 160, each of which is in electrical communication with the electronic control assembly 14. The first disc sensor 156 produces a first output when actuated by the first disc 78. Preferably, the first disc sensor 156 is a micro switch mounted on the second segment 32*b* of the first plate 32 adjacent the first disc 78, engages a shoulder (not shown) on the first disc 78 and produces the first output when the first disc 78 is rotated from the first angular position.

The second disc sensor 158 produces a second output when actuated by the second disc 84. Preferably, the first disc sensor 158 is a micro switch mounted on the second segment 32*b* of the first plate 32 adjacent the second disc 84, engages a shoulder (not shown) on the second disc 84 and produces the second output when the second disc 84 is rotated from the second angular position.

The first finger sensor 160 produces a third output when actuated by the first finger 80. Preferably, the first finger sensor 160 is a micro switch mounted on the first segment 32*a* of the first plate 32 adjacent the first finger 80, engages a shoulder (not shown) on the first finger and produces the third output when the first finger 80 is rotated from the first engaged position.

Referring to FIGS. 1 and 7–11, the electronic control assembly 14 has a user interface 162 mountable on the outside-facing surface 6 of the door 1 and a controller 164 mounted on the inside-facing surface 3 of the door 1. The user interface 162 has a case 166 with an electronic card reader 180 therein. The card reader 180 can be any well known electric reader such as the card reader for the HT28-Smart™ electronic lock system manufactured by Onity, Inc. Atlanta, Ga. The case 166 has a front bezel 168 with a slot 170 for receiving an encoded card 172. A beveled sidewall 174 forms the perimeter of the slot 170.

A first guide 176 is generally centrally positioned on the front bezel 168 above the slot 170. The first guide 176 is for directing a user's attention to the slot 170 and for providing a first registry point for a first corresponding guide 173 on a first surface of the encoded card 172. Preferably, but not necessarily, the first guide 176 has the general shape of an arrow pointing to the slot 170 and the first corresponding guide 173 on the encoded card 172 is also an arrow indicating the end of the encoded card 172 to be inserted in the slot 170. Alternatively, the first guide 176 could have other shapes such as a pointing finger. The first guide 176 could also be a written instruction such as "Insert Card Here" without departing from the scope of the invention. Similarly, the first corresponding guide 173 can have various shapes without departing from the scope of the invention.

A second guide 178 is offset from the center of the slot 170 and is positioned below the slot 170 on the beveled sidewall 174 of the front bezel 168. The second guide 178 is for indicating the position of a reading head (not shown) of the card reader 180 within the case 166 and is also for providing a second registry point for a second corresponding guide 175 on a second surface of the encoded card 172. Preferably, but not necessarily, the second guide 178 is three raised marks. Alternatively, the second guide 178 could be a variety of other marks such as a black strip extending into the slot without departing from the scope of the invention. Preferably, the second corresponding guide 175 is a magnetic strip or other electronically readable medium.

A status indicator 182 is also included as part of the user interface 162. Preferably the status indicator 182 is one or more light emitting diodes ("LED") mounted on the front bezel 168 or under the first guide 176 if the first guide 176 is translucent. Preferably, the status indicator 182 includes a green LED to provide a visual indication that the status of the Lock System 10 is "unlocked" and a red LED to provide a visual indication that the status of the Lock System 10 is "locked".

In addition to, or in lieu of, the card reader 180, the user interface 162 could have a keypad 184 (FIG. 8), a biometric identification sensor such as a finger scanner 186 (FIG. 9), an eye-scanner (not shown), a face or voice recognition sensor (not shown) or other electronic readers or access controls without departing from the scope of the invention.

The controller 164 can be a variety of well known controllers suitable for use with an electromechanical device for opening and securing the lock 2. One such controller is the controller disclosed in U.S. Pat. No. 5,591,950 (Imedio-Ocaña) incorporated herein in its entirety. The controller 164 is housed in the lock assembly housing 16 and is in electrical communication with the user interface 162, the drive assembly 24 and the sensor assembly 26. The controller 164 may also be in electrical communication with a remote, central controller (not shown) such as a processor at a hotel check-in desk. The controller 164 is configured to determine a condition of the clutch assembly 22 based on the output of the sensor assembly 26.

In use the Lock System 10 is mounted on the door 1 as shown schematically in FIG. 1 and the first spindle 48 is connected to the mortise lock 2 in one of a variety of methods well known by those skilled in the art. When the door 1 is in the closed position in the doorframe, the latch of the mortise lock assembly projects beyond the edge of the door 1 and into an opening in the adjacent strike plate in the doorframe. The first and second fingers 80, 82 of the clutch assembly 22 are in the first and second engaged positions, respectively, and oppose rotation of the first spindle 48, thereby securing the door in the closed position.

To open the door, the encoded card 172 must be read by the card reader 180 and the authority to open the door must be confirmed. This is accomplished by positioning the encoded card 172 such that the first corresponding guide 173 on the card 172 is in registry with the first guide 176 on the front bezel 168 of the user interface 162 and the second corresponding guide 175 on the card 172 is in registry with the second guide 178 on the beveled sidewall 174 of the front bezel 168. In this orientation, the encoded card 172 is insertable in the slot 170. Upon insertion of the encoded card 172 in the user interface 162 or extraction of the encoded card 172 from the user interface 162, the controller 164 verifies the identity of the encoded card 172 by comparing the encoding on the card 172 with a code stored in the controller 164.

Upon verification of the card 172, the controller 164 causes the drive motor 150 to rotate the flexible link 152. The first link 104 slides along the rotating flexible link 152, thereby pivoting the first finger 80 from the first engaged position, in which the first stop 106 is in registry with the first contact 88 and opposes rotation of the first disk 78 and the first spindle 48 attached thereto, to the first disengaged position in which the first stop 106 is spaced from the first contact 88. In the alternatively configured flexible link discussed above, as the drive motor 150 rotates the worm gear, the nut constrained by a guide (not shown) moves along the rotational axis of the worm gear, thereby displacing the spring and pivoting the first finger 80. The pivoting of the first finger 80 causes the second finger 82 to also pivot from the second engaged position, in which the second stop 124 is in registry with the second contact 90 and also opposes rotation of the first disk 78 and the first spindle 48 attached thereto, to a second disengaged position in which the second stop 124 is spaced from the second contact 90.

When the first and second fingers 80, 82 are in the first and second disengaged positions, the outside handle 4 attached to the first spindle 48 is now freely rotatable to retract the latch of the mortise lock assembly 2 from the opening in the strike plate. The door 1 is now freely rotatable to an open position. After a predetermined time delay, the first and second fingers 80, 82 are rotated by the drive assembly 24 to the first and second engaged positions, and the first spindle 48 is secured against rotation.

As already discussed above, rotation of the second spindle 64 rotates the first spindle 48 allowing the door 1 to be opened from the inside or secured side at any time.

Those skilled in the art will appreciate that changes could be made to the embodiments described above without departing from the broad inventive concept thereof. For example, while the invention has been particularly shown and described with reference to a mortise lock assembly as a certain preferred embodiment, the invention is also applicable to tubular latches, bored locks, rim locks, panic devices and, in general, devices requiring a clutch assembly for coupling a first spindle to a second spindle. It is understood, therefore, that this invention is not limited to the particular embodiments disclosed, but it is intended to cover modifications within the spirit and scope of the present invention as defined by the appended claims.

We claim:

1. A clutch assembly for coupling a first spindle to a second spindle, the clutch assembly comprising:

a first disc connectable to the first spindle and rotatable about a first axis, the first disc having a first couple;

a first finger operatively coupled to the first disc and pivotable about a second axis between a first engaged position and a first disengaged position, the second axis spaced from and parallel to the first axis, the first finger configured to oppose rotation of the first disc in a first direction when the first finger is in the first engaged position; and a second disc connectable to the second spindle, the second disc having a first slot engaged by the first couple, the second disc configured to pivot the first finger from the first engaged position to the first disengaged position when the second disc is rotated in the first direction through a first range of angular positions and to rotate the first disc in the first direction when the second disc is rotated beyond the first range of angular positions, wherein the first disc has a first contact, and the first finger has a first stop spaced a first radius from the second axis and configured to apply to the first contact a reactive force opposing rotation of the first disc in the first direction when the first finger is in the engaged position.

2. The clutch assembly according to claim 1, wherein the reactive force is directed outwardly along the first radius.

3. A clutch assembly for coupling a first spindle to a second spindle, the clutch assembly comprising:

a first disc connectable to the first spindle and rotatable about a first axis, the first disc having a first couple;

a first finger operatively coupled to the first disc and pivotable about a second axis between a first engaged position and a first disengaged position, the second axis spaced from and parallel to the first axis, the first finger configured to oppose rotation of the first disc in a first direction when the first finger is in the first engaged position; and a second disc connectable to the second spindle, the second disc having a first slot engaged by the first couple, the second disc configured to pivot the first finger from the first engaged position to the first disengaged position when the second disc is rotated in the first direction through a first range of angular positions and to rotate the first disc in the first direction when the second disc is rotated beyond the first range of angular positions, wherein the first finger has a first link and is driven by a drive assembly comprising a drive motor connected to the first link by a flexible link.

4. A clutch assembly for coupling a first spindle to a second spindle, the clutch assembly comprising:

a first disc connectable to the first spindle and rotatable about a first axis, the first disc having a first couple;

a first finger operatively coupled to the first disc and pivotable about a second axis between a first engaged position and a first disengaged position, the second axis spaced from and parallel to the first axis, the first finger configured to oppose rotation of the first disc in a first direction when the first finger is in the first engaged position; and a second disc connectable to the second spindle, the second disc having a first slot engaged by the first couple, the second disc configured to pivot the first finger from the first engaged position to the first disengaged position when the second disc is rotated in the first direction through a first range of angular positions and to rotate the first disc in the first direction when the second disc is rotated beyond the first range of angular positions, wherein a first sensor is adjacent the first disc, the first sensor having a first sensor output when actuated by the first disc; a second sensor is adjacent the second disc, the second sensor having a second output when actuated by the second disc; and a third sensor is adjacent the first finger, the third sensor having a third sensor output when actuated by the first finger.

5. The clutch assembly according to claim 4, where the first sensor, the second sensor and the third sensor are in communication with a controller.

6. A clutch assembly for coupling a first spindle to a second spindle, the clutch assembly comprising:

a first disc connectable to the first spindle and rotatable about a first axis, the first disc having a first couple;

a first finger operatively coupled to the first disc and pivotable about a second axis between a first engaged position and a first disengaged position, the second axis spaced from and parallel to the first axis, the first finger configured to oppose rotation of the first disc in a first direction when the first finger is in the first engaged position; and a second disc connectable to the second spindle, the second disc having a first slot engaged by the first couple, the second disc configured to pivot the first finger from the first engaged position to the first disengaged position when the second disc is rotated in the first direction through a first range of angular positions and to rotate the first disc in the first direction when the second disc is rotated beyond the first range of angular positions, wherein:

the first disc has a first contact, a second contact, and a second couple, the second contact spaced from the first contact;

the first finger has a first stop, a first link, and a first lobe, the first stop spaced a first radius from the second axis and configured to apply to the first contact a first reactive force opposing rotation of the first disc in the first direction when the first finger is in the engaged position, the first link connected to a drive assembly;

a second finger is operatively coupled to the first disc and pivotable about a third axis between a second engaged position and a second disengaged position, the third axis spaced from and parallel to the first and second axes, the second finger having a second stop and a second link, the second stop spaced a second radius from the third axis and configured to apply to the second contact a second reactive force opposing rotation of the first disc in a second direction when the second finger is in the second engaged position, the second link configured to engage the first lobe and to cause the second finger to pivot between the second engaged position and the second disengaged position when the first finger pivots between the first engaged position and the first disengaged position;

the second disc has a second slot engaged by the second couple, the second disc configured to pivot the second finger from the second engaged position to the second disengaged position when the second disc is rotated in a second direction through a second range of angular positions and to rotate the first disc in the second direction when the second disc is rotated beyond the second range of angular positions.

7. The clutch assembly according to claim 6, wherein the first finger has a first release;

the second finger has a second release; and the second disc has a first perimeter surface with a first portion and a second portion spaced from the first portion, the first portion configured to engage the first release, to pivot the first finger from the first engaged position to the first disengaged position when the second disc is rotated in the first direction through a first range of angular positions, and to rotate the first disc in the first direction when the second disc is rotated beyond the first range of angular positions, the second portion configured to engage the second release, to pivot the second finger from the second engaged position to the second disengaged position when the second disc is rotated in the second direction through a second range of angular positions, and to rotate the first disc in the second direction when the second disc is rotated beyond the second range of angular positions.

8. An electronic lock system for a door having an outside handle, an outside-facing surface, an inside handle, an inside-facing surface and a latch assembly, the electronic lock system comprising:

(a) an electronic lock assembly comprising:

(i) a lock assembly housing connectable to the inside-facing surface of the door; the lock housing assembly comprising: a base having a sidewall; a first plate spaced from and supported by the base; a second plate spaced from and supported by the first plate; and a cover spaced from the second plate and removably supported by the sidewall;

(ii) a first spindle assembly between the base and the first plate, the first spindle assembly connectable to the outside handle and to the latch assembly;

(iii) a second spindle assembly between the second plate and the cover, the second spindle assembly connectable to the inside handle;

(iv) clutch assembly between the first plate and the second plate, the clutch assembly connecting the first spindle assembly to the second spindle assembly;

(v) a drive assembly connected to the clutch assembly; and (vi) a sensor assembly adjacent the clutch assembly, the sensor assembly having an output when actuated by the clutch assembly; and (b) an electronic control assembly comprising:

(i) a user interface; and (ii) a controller in electrical communication with the user interface, the drive assembly, and the sensor assembly, the controller configured to determine a condition of the clutch assembly based on the output of the sensor assembly, wherein:

the first spindle assembly comprises a first spindle extending through the first plate and the base, the first spindle having a first end and a second end, the first end connectable to the outside handle, the first spindle rotatable about a first axis from a first angular position; and a first spindle return connected to the first spindle and configured to bias the first spindle in the first angular position;

the second spindle assembly comprises a second spindle extending through the second plate and the cover, the second spindle having a first end and a second end, the first end connectable to the inside handle, the second spindle rotatable about the first axis from a second angular position; and a second spindle return connected to the second spindle and configured to bias the second spindle in the second angular position; and the clutch assembly comprises:

a first disc connectable to the first spindle and rotatable about the first axis, the first disc having a first contact, a second contact spaced from the first contact, a first couple and a second couple spaced from the first couple;

a first finger operatively coupled to the first disc and pivotable about a second axis between a first engaged position and a first disengaged position, the second axis spaced from and parallel to the first axis, the first finger having a first link, first stop, a first release, and a first lobe, the first link connected to the drive assembly, the first stop spaced a first radius from the second axis and configured to apply to the first contact a first reactive force opposing rotation of the first disc in the first direction when the first finger is in the engaged position;

a second finger operatively coupled to the first disc and pivotable about a third axis between a second engaged position and a second disengaged position, the third axis spaced from and parallel to the first and second axes, the second finger having a second link, a second stop, and a second release, the second link configured to engage the first lobe of the first finger and couple the pivoting of the first finger with the pivoting of the second finger, the second stop spaced a second radius from the third axis and configured to apply to the second contact a second reactive force opposing rotation of the first disc in a second direction when the second finger is in the second engaged position;

a second disc connectable to the second spindle, the second disc rotatable about the first axis, the second disc having a first slot engaged by the first couple, a second slot engaged by the second couple, and a first perimeter surface with a first portion and a second portion spaced from the first portion, the first portion configured to engage the first release, to pivot the first finger from the first engaged position to the first disengaged position when the second disc is rotated in the first direction through a first range of angular positions, and to rotate the first disc in the first direction when the second disc is rotated beyond the first range of angular positions, the second portion configured to engage the second release, to pivot the second finger from the second engaged position to the second disengaged position when the second disc is rotated in the second direction through a second range of angular positions, and to rotate the first disc in the second direction when the second disc is rotated beyond the second range of angular positions; and the sensor assembly comprising:

a first sensor adjacent the first disc, the first sensor having a first sensor output when actuated by the first disc;

a second sensor adjacent the second disc, the second sensor having a second output when actuated by the second disc; and a third sensor adjacent the first finger, the third sensor having a third sensor output when actuated by the first finger.

* * * * *